US006382856B2

(12) United States Patent
Hu

(10) Patent No.: US 6,382,856 B2
(45) Date of Patent: May 7, 2002

(54) SUPPORT LINKAGE FOR KEYSWITCH

(75) Inventor: Gino Hu, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/865,436

(22) Filed: May 29, 2001

Related U.S. Application Data

(63) Continuation-in-part of application No. 09/108,219, filed on Jul. 1, 1998.

(51) Int. Cl.[7] ..... B41J 5/14
(52) U.S. Cl. ..... 400/495; 400/490
(58) Field of Search ..... 400/495, 491.2, 400/491, 490, 472; 200/344, 341

(56) References Cited

U.S. PATENT DOCUMENTS 5,488,210 A * 1/1996 Shigetaka et al. ..... 200/344
5,986,227 A * 11/1999 Hon ..... 200/344

* cited by examiner

*Primary Examiner*—John S. Hilten
*Assistant Examiner*—Anthony H. Nguyen
(74) *Attorney, Agent, or Firm*—Rosenberg, Klein & Lee

(57) ABSTRACT

A support linkage movably connecting a key cap to a plastic body comprises a first rack and a second rack. The first rack has a first rack body movably connected between the key cap and the plastic body, and the second rack has a second rack body movably connected between the key cap and the plastic body. The second rack body has two axial holes each having an open side and engaged with a shaft on the first rack body.

3 Claims, 15 Drawing Sheets

SUPPORT LINKAGE FOR KEYSWITCH

CROSS-REFERENCE TO RELATED PATENT APPLICATIONS

This Patent Application is a Continuation-in-Part Application of application Ser. No. 09/108,219, filed Jul. 1, 1998, and entitled KEYSET OF KEYBOARD.

FIELD OF THE INVENTION

The present invention relates to a support linkage for keyswitch, more particularly, to a support linkage for keyswitch, which can be easily assembled and is not liable to deform or break during assembling.

BACKGROUND OF THE INVENTION

The conventional keyset for notebook computer generally comprises a key cap 2, a first rack 1, a second rack 3, a flexible circuit board 4, a resilient body 6, and a base plate 5.

As shown in FIG. 1 and 2, the conventional first rack 1 and second rack 2 are arranged in scissors arrangement. When the key cap 2 is guided by the first rack 1 and the second rack 3 to move upward and downward, whereby the body 6 below the key cap 2 can press on or detach from the flexible circuit board 4 to turn on or turn off the keying.

However, the lateral sides of the rack 1, 3 in conventional art have not sufficient strength such that the racks are liable to deform or break during assembling or detach. Moreover, the assembling of those racks is not easy and requires precise alignment to prevent jamming.

It is the object of the present invention to provide a support linkage for keyswitch, the racks thereof are designed to have easy assembling without the usage of auxiliary tools, and have better strength to prevent the deforming and breaking during assembling or disassemble.

To achieve the above object, the support linkage for keyswitch according to the present invention comprises a first rack and a second rack. The first rack has a first rack body movably connected between the key cap and the plastic body, and the second rack has a second rack body movably connected between the key cap and the plastic body. The second rack body has two axial holes each having an open side and engaged with a shaft on the first rack body.

The various objects and advantages of the present invention will be more readily understood from the following detailed description when read in conjunction with the appended drawing, in which:

DETAILED DESCRIPTION OF THE PREFERRED EMBODIMENT

Figure 1:
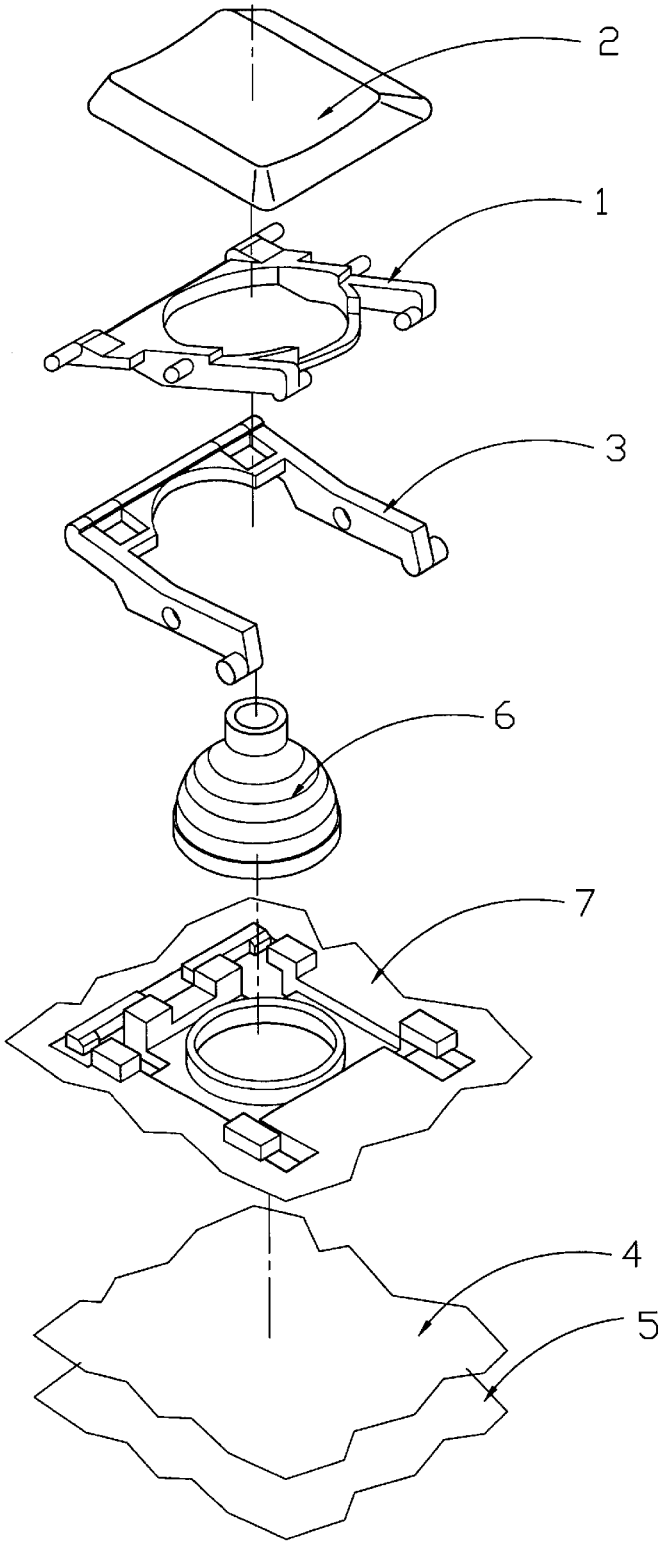
FIG.1 PRIOR ART
FIG. 1 is the perspective exploded view of the conventional keyset.
Figure 2:
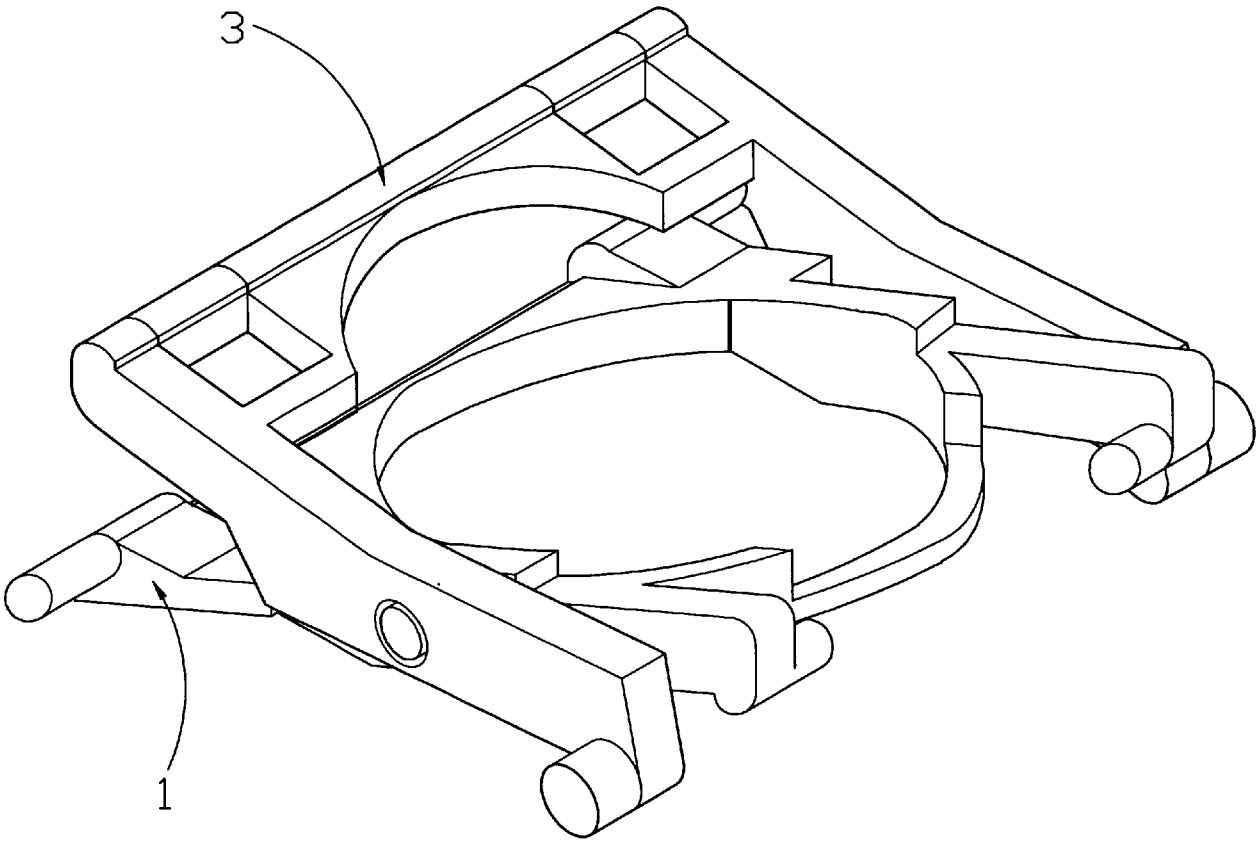
FIG.2 PRIOR ART
FIG. 2 is the perspective view of the scissors-type rack in conventional keyset.
Figure 3:
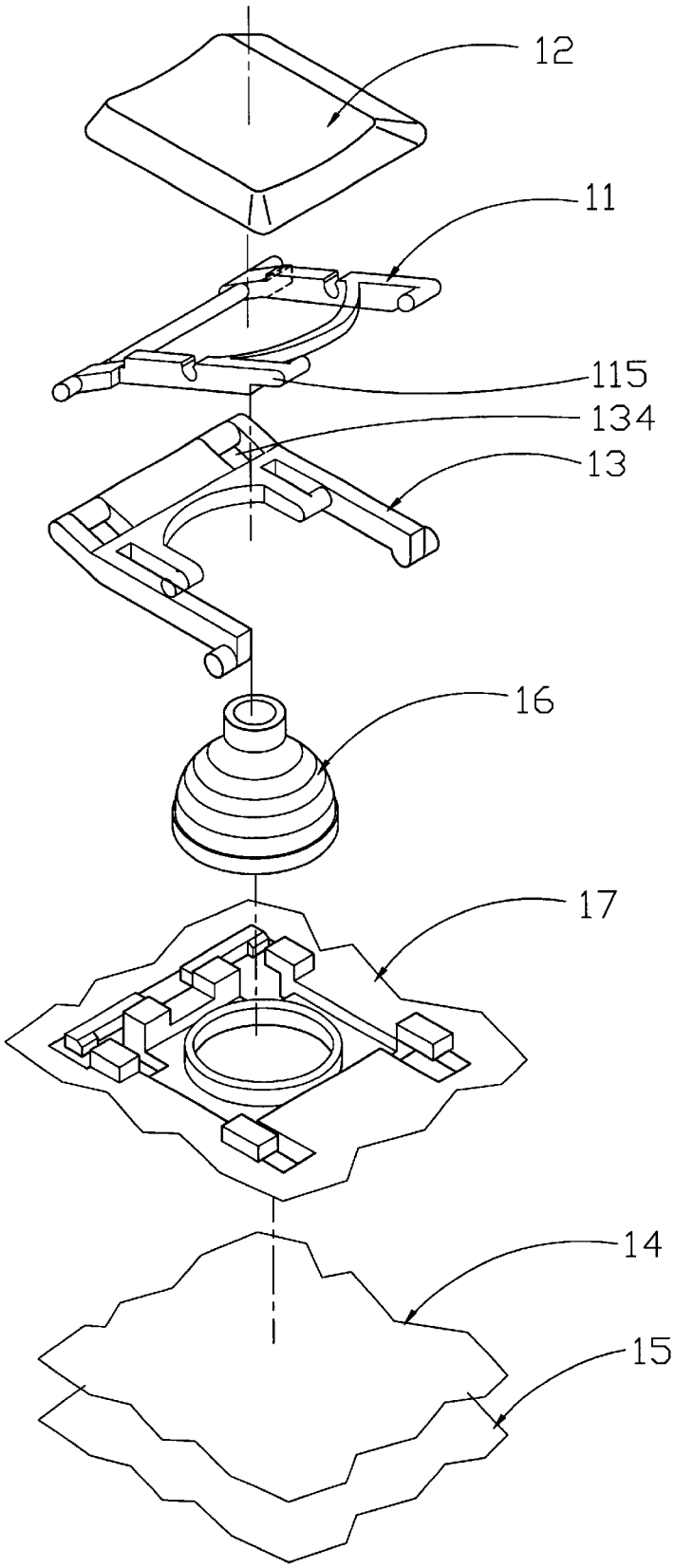
FIG. 3 is a perspective exploded view of the preferred embodiment of the invention.

FIG. 3 is a perspective view of the preferred embodiment of the present invention. A support linkage of this preferred embodiment includes a keycap 12, a first rack 13, a second rack 1, a plastic body 17, a soft printed circuit board 14, a resilient body 16, and a base plate 15. The rectangular-shaped keycap 12 has two embedding parts 121 (FIG. 12) on one upper lateral side within the inner space thereof to clamp the first rack 13 and two retaining grooves 123 (also shown in FIG. 12) on the other upper lateral side to clamp the second rack 11.

The first rack 13 is arranged below the keycap 12 and the keycap 12 is in a scissor-like arrangement with the second rack 11. The retaining grooves 134 of the first rack 13 engage with the embedding parts 121 of the keycap 12. The second rack II includes a fourth shaft 115 to engage with the retaining grooves 123 of the keycap 12.

The plastic body 17 is arranged below the first rack 13 and the second rack 11. The plastic body 17 is provided with a through hole for the penetration of the resilient body 16 on the location corresponding to the keycap 12. Two axial holes 118 are set on both sides of the second rack 11 and these axial holes are used to engage with the first rack 13.

The resilient body 16 is arranged below the first rack 13 and the second rack 11 and is within the through hole of the plastic body 17. The resilient body 16 is functioned to support the first rack 13 and the second rack 11.

The soft printed circuit board 14 is arranged below the plastic body 17 and the base plate 15 is set below the soft printed circuit board 14.

Figure 4:
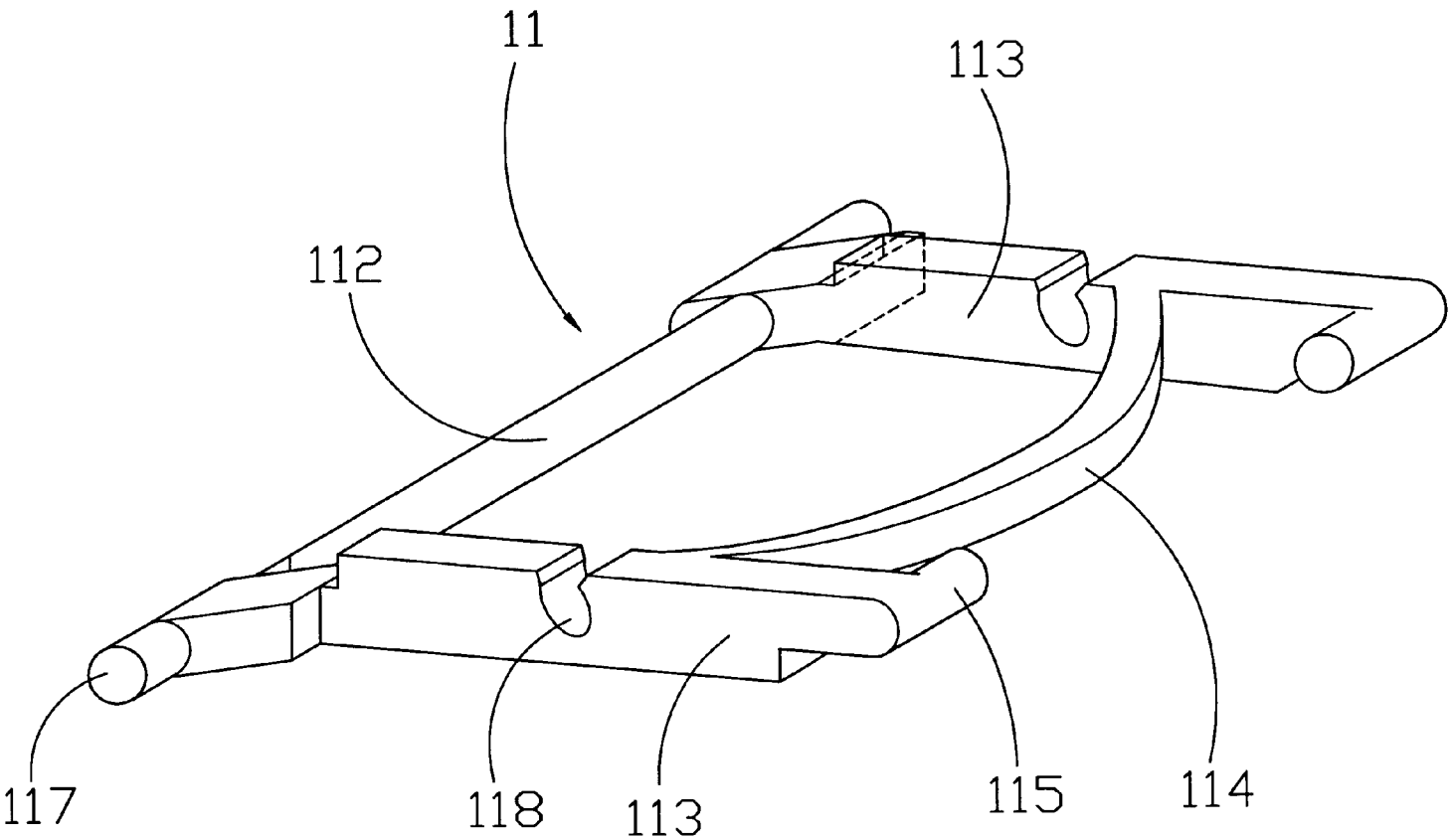
FIG. 4 is the perspective view of the second rack of the preferred embodiment according to the invention
Figure 5:
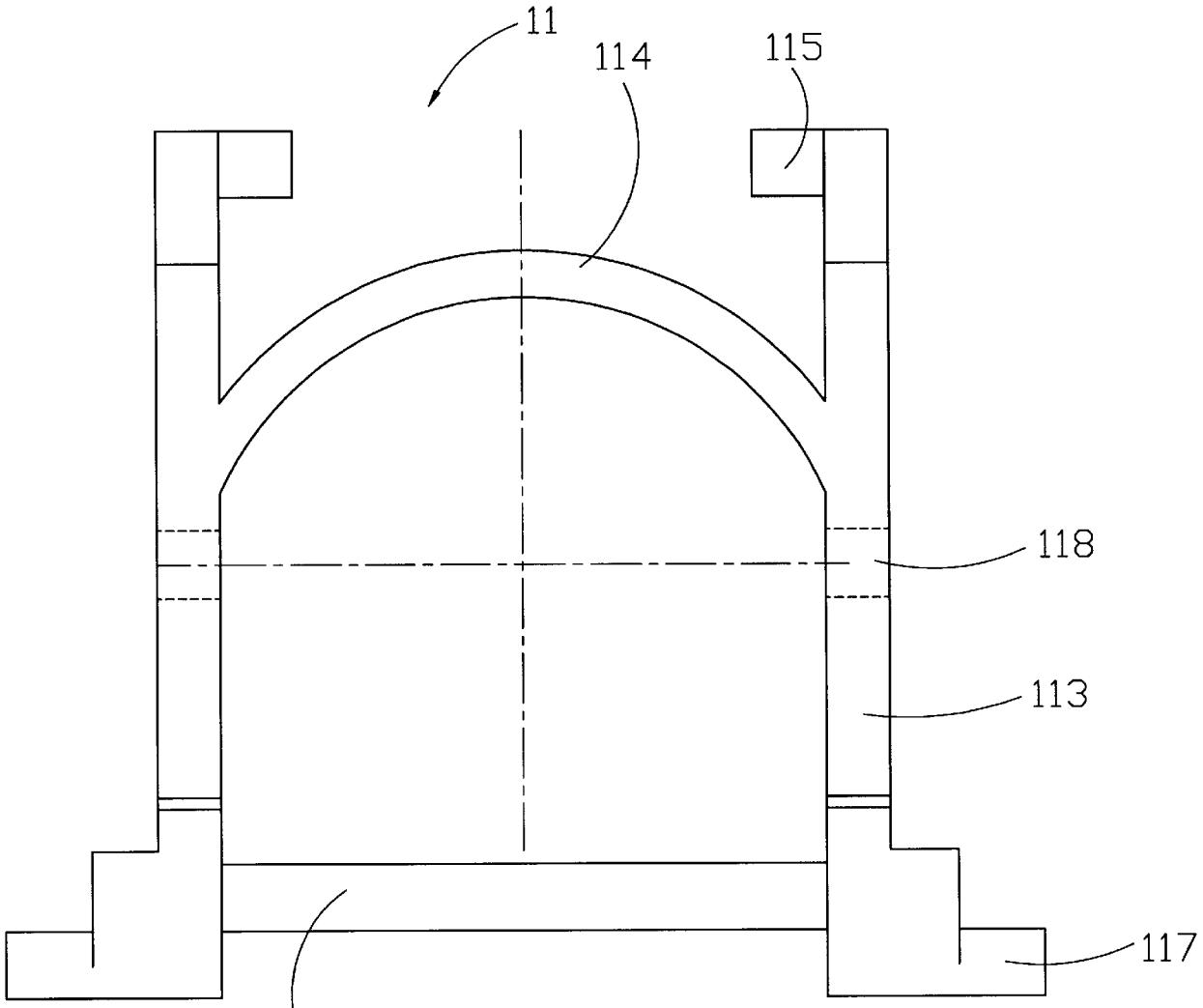
FIG. 5 is the top view of the second rack of the preferred embodiment according to the invention.
Figure 6:
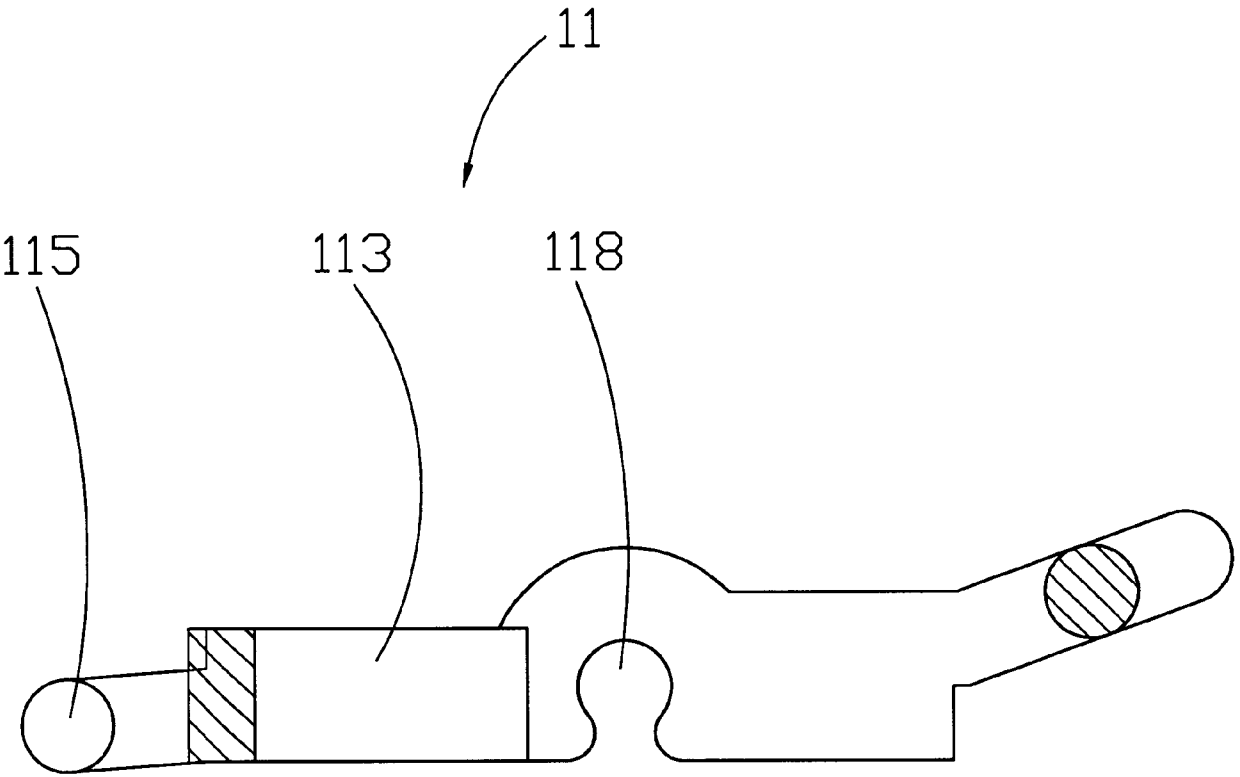
FIG. 6 is the cross section view of the second rack of the preferred embodiment according to the invention.

Please refer to FIGS. 4–6, FIG. 4 is a schematic diagram of the second rack 11, FIG. 5 is a top view of the second rack 11, and FIG. 6 is a side view of the second rack 11. The second rack 11 includes two opposed rack bodies 113, both of which are connected by a connection part 112 and an arc-shaped part 114. One end of each rack body 113 has a fourth shaft 115 opposed to its counterpart, and two third shafts 117 extend from the other two ends of the rack bodies 113. The axial holes 118 are set on two rack bodies 113 respectively. Each of the axial holes 118 has an open side as shown as in FIG. 4.

Figure 7:
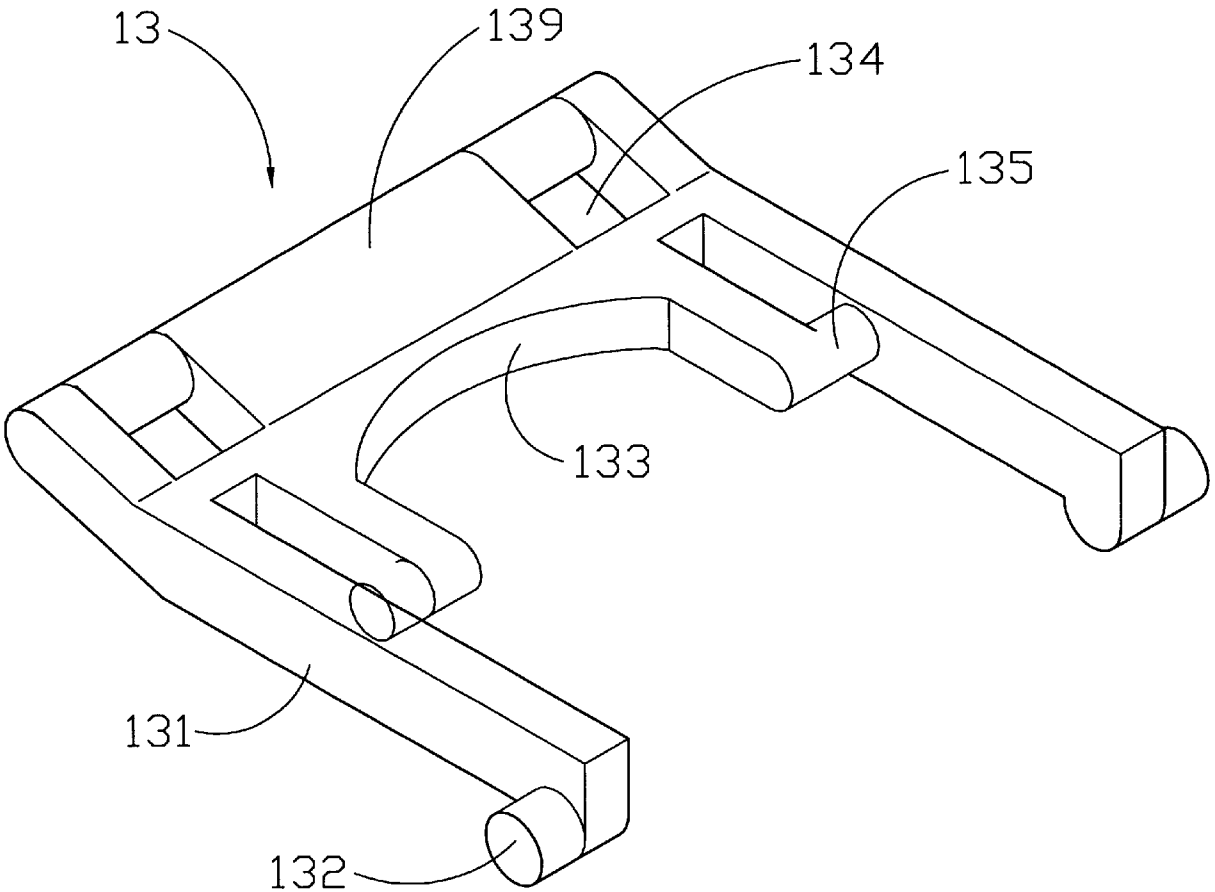
FIG. 7 is the perspective view of the first rack of the preferred embodiment according to the invention
Figure 8:
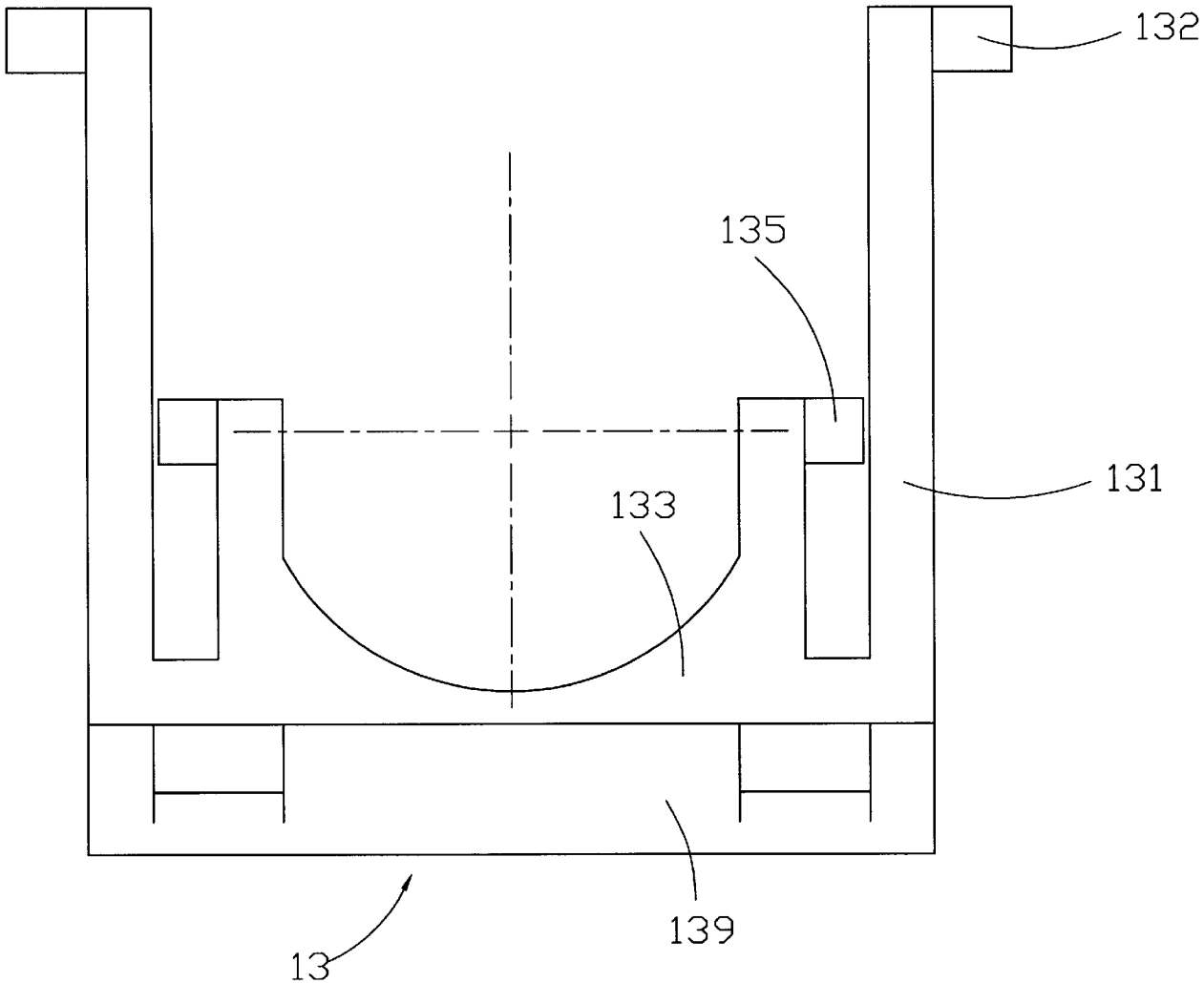
FIG. 8 is the top view of the first rack of the preferred embodiment according to the invention.
Figure 9:
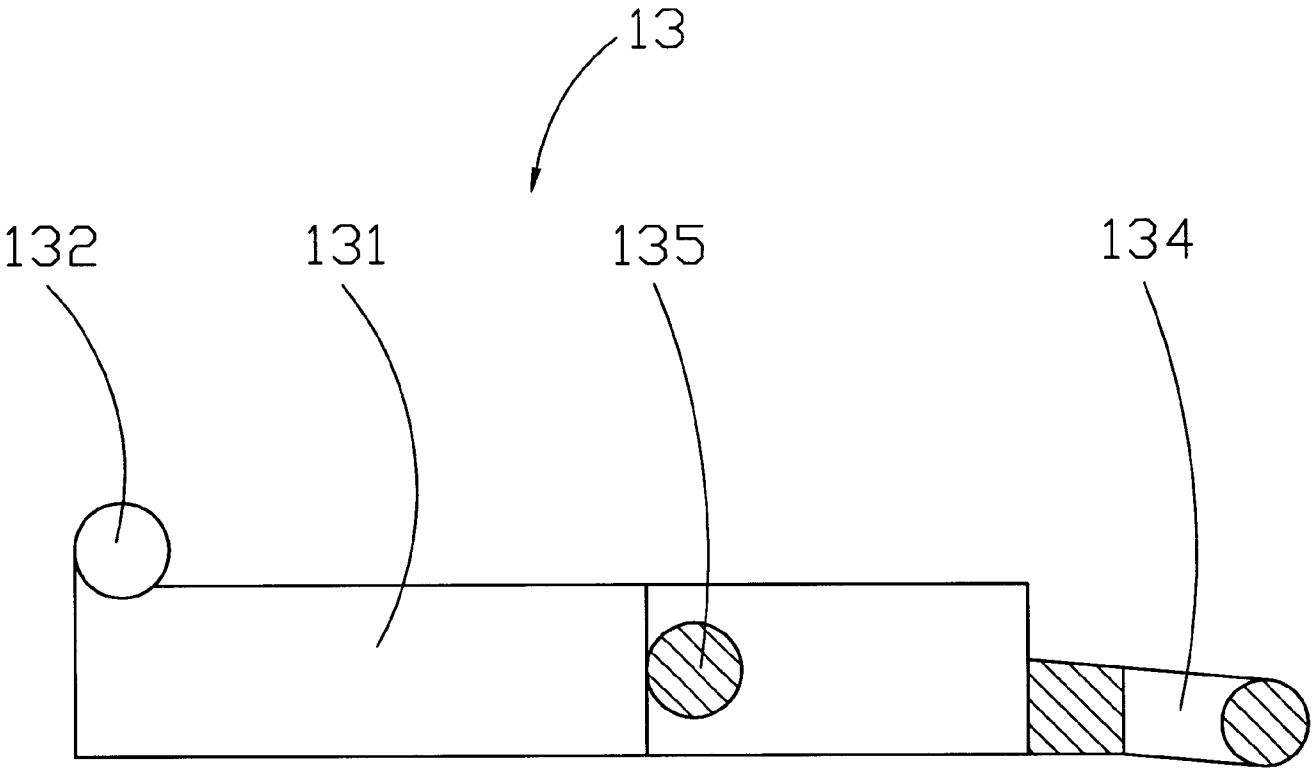
FIG. 9 is the cross section view of the first rack of the preferred embodiment according to the invention.

Please refer to FIGS. 7–9, FIG. 7 is a schematic diagram of the first rack 13, FIG. 8 is a top view of the first rack 13, and FIG. 9 is a side view of the first rack 13. The first rack 13 has an inverse-U shaped rack body 131, including a U-shaped arm portion 133 on the inner side thereof. Please refer to FIG. 4 in conjunction with FIG. 7, the arm portion 133 has two second shafts 135 on two lateral sides thereof and their locations are corresponding to those of the axial holes 118 of the second rack 11. Moreover, the width of the open side of the axial hole 118 is smaller than the maximum width of the second shaft 135, leading to the second shaft 135 can be easily assembled into the axial hole 118 and retained within the axial hole 118 stably.

The inverse-U shaped rack body 131 also includes a connection side 139 and two grooves 134 are set on two ends of the connection body 139 respectively. These grooves 134 are set to engage with corresponding embedding parts 121 of the keycap 12 (shown in FIG. 12). Two first shafts 132 are set on the inverse-U shaped rack body 131 for engaging with the plastic body 17 (also shown in FIG. 12).

Figure 10:
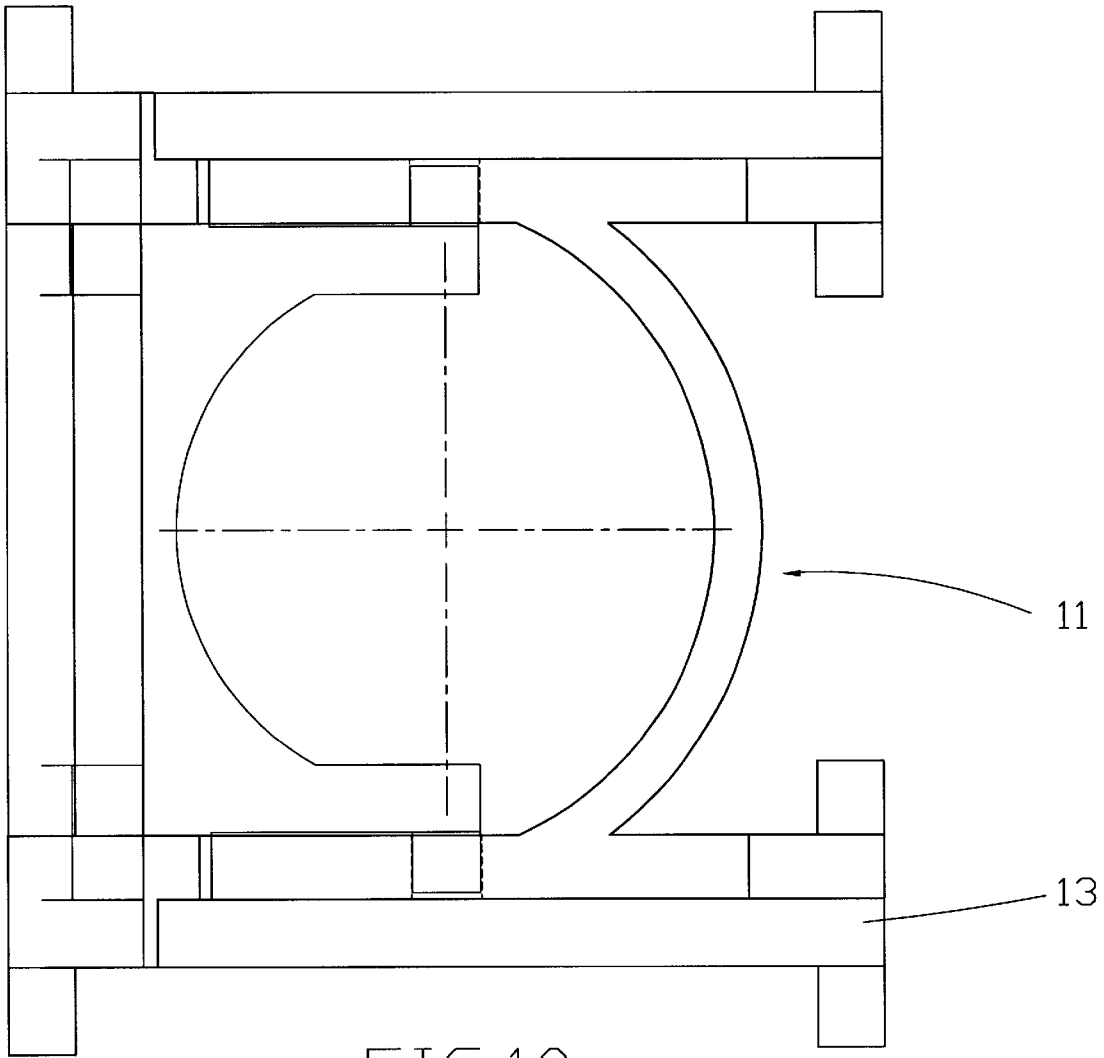
FIG. 10 is a top view shows the first and second racks of the preferred embodiment according to the invention in scissors arrangement.
Figure 11:
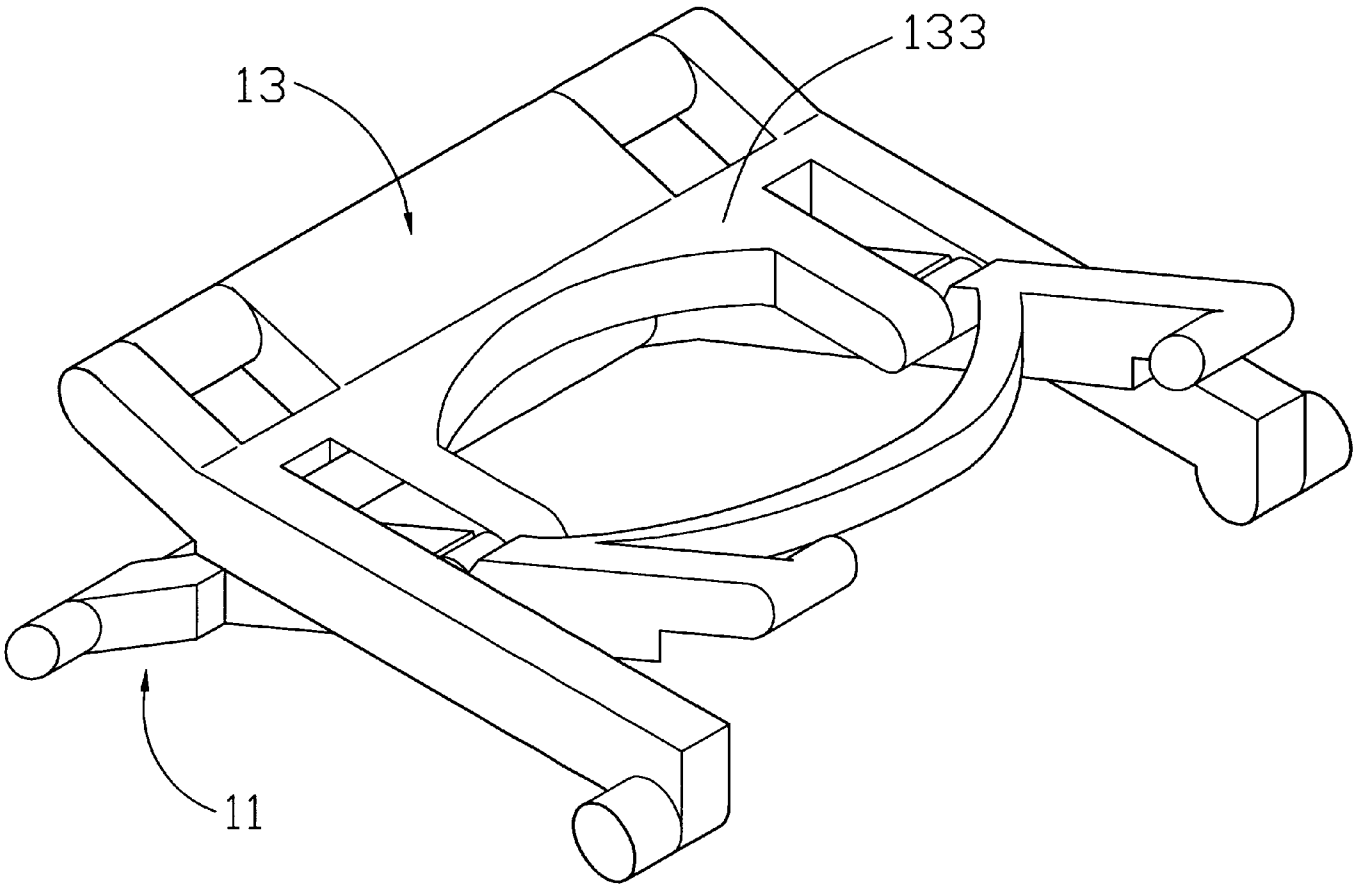
FIG. 11 is a perspective view shows the first and second racks of the preferred embodiment according to the invention in scissors arrangement.

Please refer to FIG. 10 and FIG. 11, FIG. 10 and FIG. 11 is a top view and a schematic diagram respectively while the first rack 13 engages with the second rack 11. The U-shaped arm portion 133 is set on the inner side of the first rack 13, resulting in the contact area between the first rack 13 and the second rack 11 increases to prevent the shaky problem of the keycap and make the assembly and the disassembly of the keycap easier. Because of the special slope design of the axial holes 118 of the second rack 11, there is no specific direction or angle while assembling the first rack 13 and the second rack 11. Furthermore, the bearing of the second rack 11 is on the innermost side of the U-shaped arm portion 133 of the first rack 13, and that's why the distortion or the breaking of those two racks can be prevented.

Figure 12:
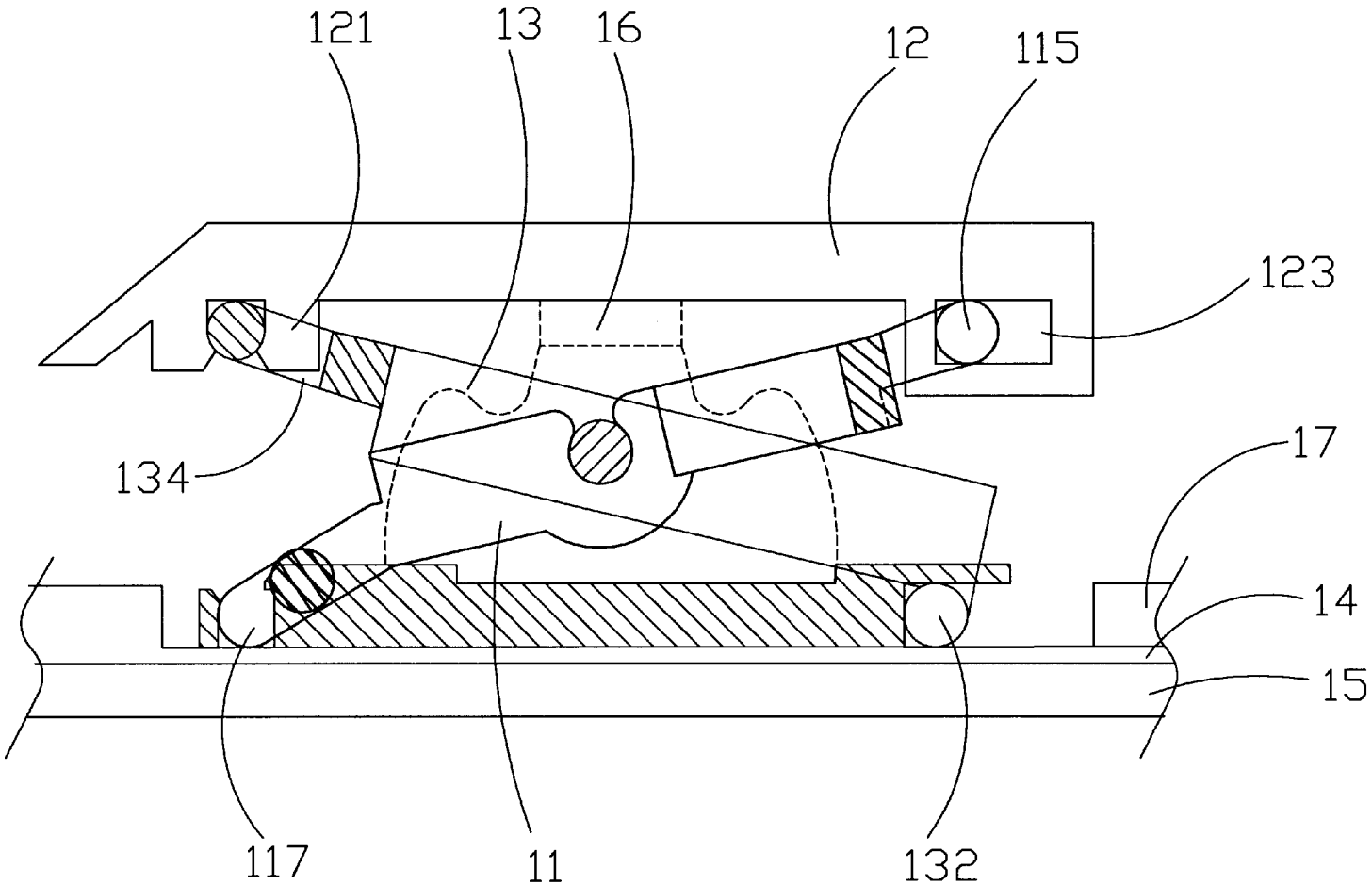
FIG. 12 is a view showing the operation of the preferred embodiment according to the invention.
Figure 13:
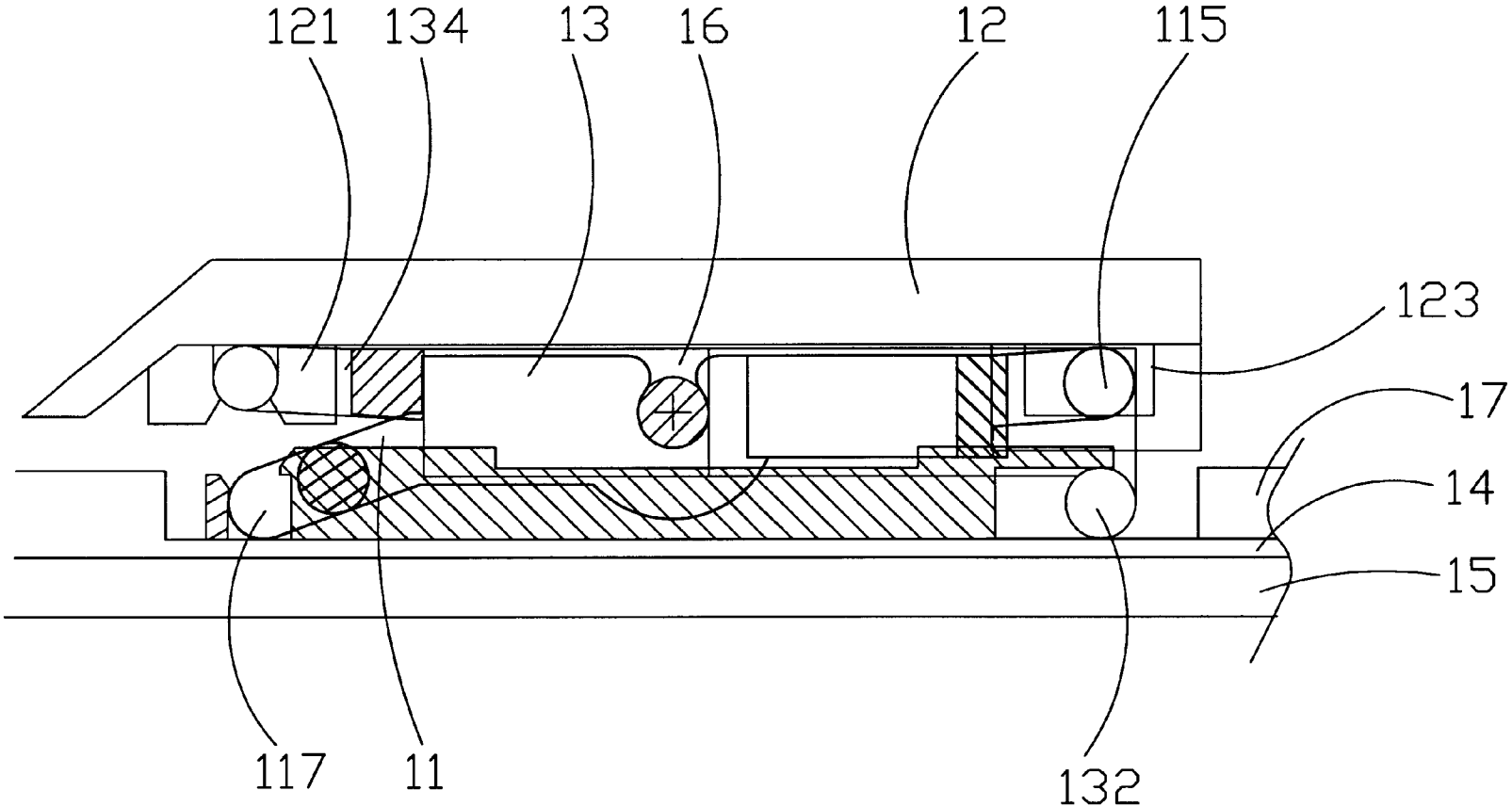
FIG. 13 is another view showing the operation of the preferred embodiment according to the invention.

Please refer to FIG. 12 and FIG. 13. FIG. 12 is a side view of the present invention, and FIG. 13 is a side view while the present invention is pressed. When the keycap 12 is pressed, it will be guided by the first rack 13 and the second rack 11 to move downward in a vertical direction. The keycap 12 will lead the resilient body 16 to press the soft printed circuit board 14 to generate a corresponding key signal. If the force is not pressed on the keycap 12, the keycap 12 will be moved upward because of he resilient force of the resilient body 16 and guided by the first rack 13 and the second rack 11, leading to the resilient body 16 does not press the soft printed circuit board 14 anymore and thus generates no key signal.

Figure 14:
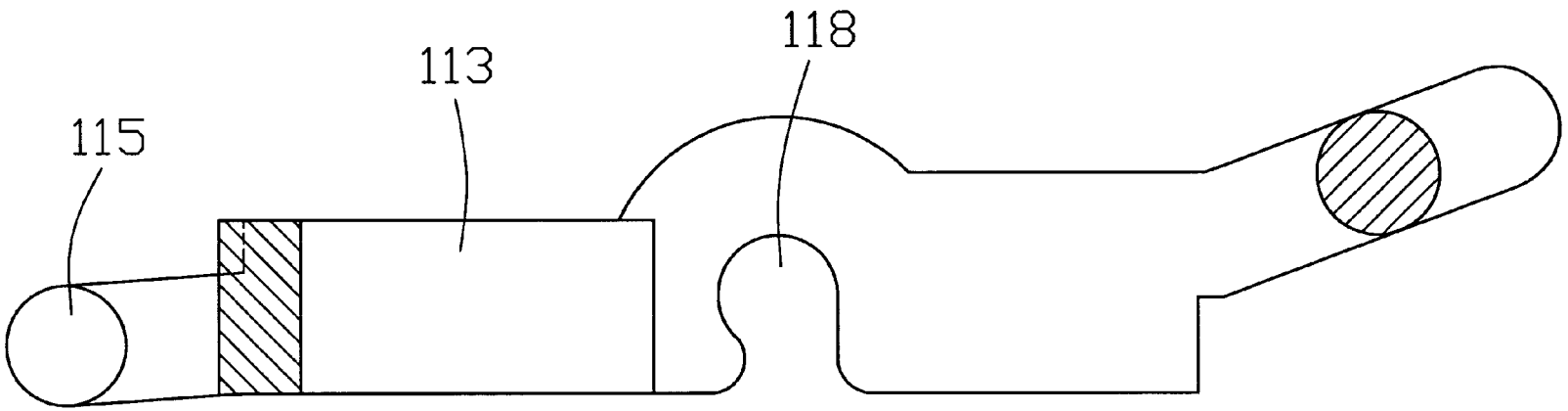
FIG. 14 is a cross sectional view of an alternate configuration of the second rack of the present invention.
Figure 15:
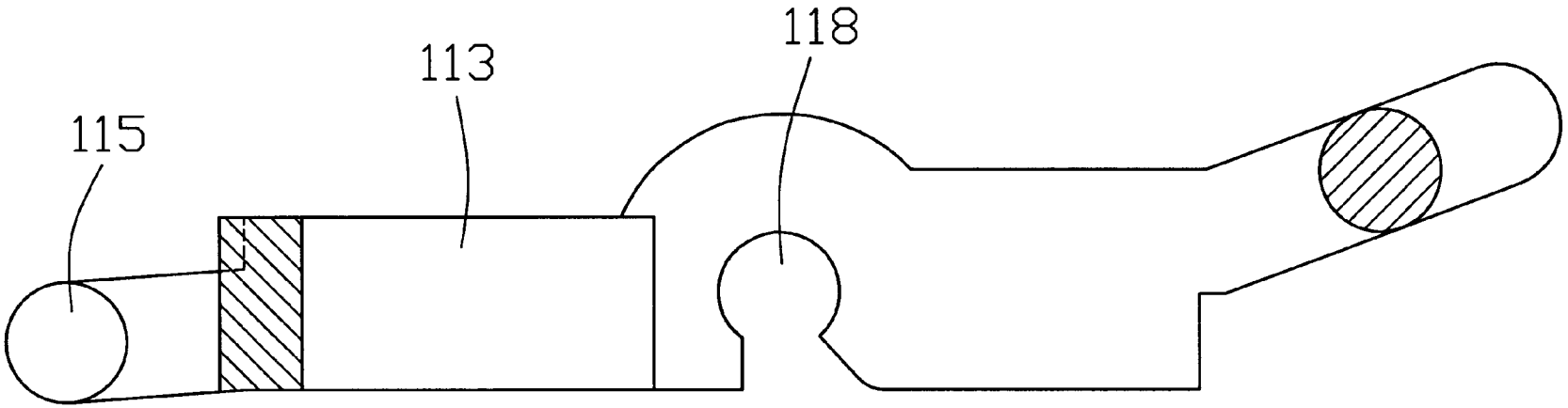
FIG. 15 is a cross sectional view of another alternate configuration of the second rack of the present invention.

Please refer to FIG. 14 and FIG. 15, FIG. 14 and FIG. 15 are two embodiments of the second rack 11. The shape of the axial hole 118 is not symmetric, and thus the second shafts 135 will engage with and retain within the axial holes 118 more tightly. As shown in FIG. 15, the axial hole 118 has a bevel surface near the open side for facilitating the automatic production.

To sum up, the inventive support linkage can solve the poor assembly and weak strength problems of its conventional counterparts.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A support linkage movably connecting a key cap to a plastic body comprising:

a first rack, said first rack having (a) a first rack body movably connected between the key cap and the plastic body, said first rack body having a pair of first shafts extending therefrom for pivotally coupling with the plastic body, and (b) an arm portion having a pair of second shafts extending therefrom; and, a second rack pivotally connected to said first rack and having a second rack body movably connected between the key cap and the plastic body, said second rack body having a pair of third shafts extending therefrom, said second rack body having a portion thereof disposed between a corresponding portion of said first rack body and said arm portion of said first rack and having an axial hole formed therein, said axial hole having an open side for receiving a corresponding one of said second shafts therein, said open side having a width smaller than a diameter of said axial hole.

2. The support linkage movably connecting a key cap to a plastic body as in claim 1, wherein said open side of each of said axial holes has a bevel surface for facilitating insertion of a respective one of said second shafts.

3. The support linkage movably connecting a key cap to a plastic body as in claim 1, wherein said open side of each of said axial holes has a non-symmetrical shape.

* * * * *